US007320622B2

(12) United States Patent
Ying et al.

(10) Patent No.: US 7,320,622 B2
(45) Date of Patent: Jan. 22, 2008

(54) MEMORY CARD ADAPTER

(75) Inventors: Hao Ying, Kunshan (CN); Jin-Kui Hu, Kunshan (CN); Guo-Hua Zhang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/599,731

(22) Filed: Nov. 14, 2006

(65) Prior Publication Data

US 2007/0111604 A1 May 17, 2007

(30) Foreign Application Priority Data

Nov. 14, 2005 (CN) ..... 2005 2 0077824
Nov. 26, 2005 (CN) ..... 2005 2 0078039

(51) Int. Cl.
*H01R 24/00* (2006.01)

(52) U.S. Cl. ..... 439/630

(58) Field of Classification Search ..... 439/630, 439/945, 946

See application file for complete search history.

(56) References Cited

U.S. PATENT DOCUMENTS 7,025,637 B1 * 4/2006 Lee ..... 439/638
7,033,223 B1 4/2006 Lin
7,040,928 B1 * 5/2006 Lai et al. ..... 439/630
7,052,295 B1 * 5/2006 Lin ..... 439/159
7,094,106 B2 * 8/2006 Yamamoto et al. ..... 439/630
7,097,512 B1 * 8/2006 Hsiao et al. ..... 439/630
7,172,464 B1 * 2/2007 Lee ..... 439/630
7,210,967 B1 * 5/2007 Lee ..... 439/630
7,226,318 B1 * 6/2007 Lee ..... 439/630
2004/0070952 A1 * 4/2004 Higuchi et al. ..... 361/737
2006/0237539 A1 * 10/2006 Chang et al. ..... 235/441
2007/0004285 A1 * 1/2007 Lee ..... 439/638
2007/0034699 A1 * 2/2007 Lin ..... 235/486

* cited by examiner

*Primary Examiner*—Tho D. Ta
*Assistant Examiner*—Vanessa Girardi
(74) *Attorney, Agent, or Firm*—Wei Te Chung

(57) ABSTRACT

A memory card adapter (100) comprises an upper cover (2), an insulating lower cover (1), a conductive member (4) and a conductive terminals module (3) fixed on the insulating lower cover. The upper cover comprises a resin cover (22) and a metal cover (21). The lower insulating cover engages with the metal cover with a mini memory card receiving space (10) formed therebetween. The conductive terminals module comprises a plurality of conductive terminals (32) electrically connecting with the conductive member and a resin beam (31) to retain the conductive terminals therein. The mini memory card (200) is accommodated in the mini memory card receiving space and electrically connecting with the conductive terminals. Due to the arrangement of the conductive terminals module with the conductive member and the insulating lower cover, the whole assembly of the adaptor is highly simplified and the conduction efficiency is increased.

17 Claims, 14 Drawing Sheets

MEMORY CARD ADAPTER

BACKGROUND OF THE INVENTION

1. Field of the Invention

The present invention generally relates to a memory card adapter, and particularly to an adapter for coupling a mini-sized memory card to a regular-sized memory card.

2. Description of Related Art

Flash memory cards developed in the recent years are light, thin and small, and with the features of high storage capacity, vibration durability, repeated memorizing for many times etc. they are widely applied in the field of information application and many portable digital products. For example, nearly all the popular products including personal digital assistants (PDA), digital cameras (DSC), digital walkmans (MP3 Players), mobile phone etc. in the markets use the flash memory cards as storage media. There is no uniform standard or specification presently in the art of flash memory cards in the whole world presently. Related products that are well known include at least: CF cards (Compact Flash cards), SM cards (Smart Media cards), MMC cards (MultiMedia cards), MS cards (Memory Stick cards) and SD cards (Secure Digital cards) etc. And more, following progressing of the science and technology, memory cards tend to be developed continuously in pursuance of the requirement of the markets. For example, the mini SD cards and micro SD cards (also called Transflash cards, T-flash cards) provided by some manufacturers recently have the same specifications as those of the SD cards, except that the size thereof is largely reduced as compared with the SD cards (the size of an SD card is: 32×24×2.1 mm, while the size of a mini SD card is 21.5×20×1.6 mm and the size of a micro SD card is 11×15×1.0 mm). This results that, although there are many support products for the SD card or mini SD card specification, the products can not support the newly developed "micro SD cards" due to inconsistence of specification of size. To resolve this problem, an adapter for accommodating a micro SD card therein and electrically and mechanically connecting with an electronic device through a regular sized receiving slot, such as a mini SD card receiving slot, is needed.

An simulated mini SD memory card converter disclosed in U.S. Pat. No. 7,033,223 B1 (hereinafter the '223 patent) is a kind of adapter to convert a micro SD card as a simulated mini SD card. This adapter is configured as a mini SD card in size, including a lower over, an upper cover, a plurality of conductive terminal and a conductive member received between the upper cover and the lower cover. Front terminals of the conductive terminals electrically connect with a front end of the conductive member, while rear terminals of the conductive terminal electrically connect with a micro SD card received in the adapter. When this adapter inserted into a mini SD card receiving slot of an electronic device, terminal plates of the conductive member electrically connects with the electronic device so that the micro SD card can be compatible by the electronic device with a mini SD card receiving slot through the adapter.

A connecting strip and a base strip bridge the conductive terminals to retain the conductive terminals in a fixed arrangement. And the conductive terminals are combined with the lower cover via a pre-confined injection molding process. After the process of combining the conductive terminals with the lower cover, the connecting strip and the base strip must be punched away. To let the waste the connecting strips drop away the lower cover, the lower cover should provide some through holes corresponding to the connecting strips. Besides, the main strip is disposed outside the lower cover to make it drop from the conductive terminal and the lower cover conveniently. The rear terminals of the conductive terminal module are disposed near a rear opening of lower cover. The front end of the conductive member is disposed near the front opening of the adapter and provided a plurality of holes electrically connecting with the front terminals. Obviously, the process to assembly the conductive terminal module and the conductive member with the lower cover and to punch away the base strip and the connecting strip are considerable complex, largely inducing the production efficiency.

Furthermore, in the '223 patent disclosure, the upper cover of the adapter is integrally molded from an insulating material, such as a resin material. When the micro SD card inserted into the receiving slot between the upper cover and the lower cover, the upper surface of the micro SD card interfere with an inner surface of the upper cover. It is inconvenient for a customer to insert/detach the micro card into/from the adapter. And with frequently inserting and drawing out of the micro SD card, warpage or deformation of the insulating upper cover easily occurs because of a lower intensity thereof.

Hence, how to improve the problems in prior art is the major discussion of the present invention.

BRIEF SUMMARY OF THE INVENTION

Accordingly, it is an object of the present invention to provide an advanced memory card adapter with a relatively simple assembly process and conductive terminals arrangement to improve conduction efficiency.

Another object of the present invention is to provide an advanced memory card adapter comprising an improved cover with enough intensity to protect a mini memory card to the adapter.

In order to achieve the above-mentioned objects, an advanced memory card adapter is provided. This memory card adapter comprises an upper cover, an insulating lower cover, a conductive member and a conductive terminals module. The upper cover comprises a resin cover and a metal cover. The insulating lower cover defines a mating end with a mating opening. The lower insulating cover engages with the resin cover and the metal cover with a receiving room and a mini memory card receiving space formed therebetween, respectively, The mini memory card is inserted into the mini memory card receiving space through the mating opening in a mating direction. The insulating lower cover is provided with at least one opening at another end thereof in communication with the receiving room. The conductive member is retained in the receiving room and comprises a plurality of conductive pads and conductive wires disposed thereon. The conductive pads are aligned with the opening of the lower cover and exposed outside. The conductive terminals module is secured on the insulating lower cover and comprises a plurality of conductive terminals and a resin beam to retain the conductive terminals therein. Each conductive terminal comprises a contacting portion electrically connecting with the mini memory cad, a tail portion electrically connecting with the conductive wires. The resin beam may be molded over the conductive terminals with the contacting portions and the tail portions extending beyond therefrom. The resin beam engages with the insulting lower cover to fix the conductive terminals module on the insulting cover firmly. Due to the arrangement of the conductive terminals module with the conductive pads and the insulating lower cover, the whole assembly of the adaptor according to the present invention is highly simplified and the conduction efficiency is increased, too.

The metal cover of the upper cover can protect the mini memory card to the memory card adapter perfectly. Furthermore, to facilitate the insertion/detaching of the mini memory card into/from the memory card adapter, the metal cover can be pivotally assembled on the insulating lower cover. Before inserting the mini memory card into the memory card adapter, the metal cover is in an opening position to allow the mini memory card into the mini memory card receiving space freely. Then the metal cover is pivoted to a closed position to secure the mini memory card retained in the mini memory card receiving space.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
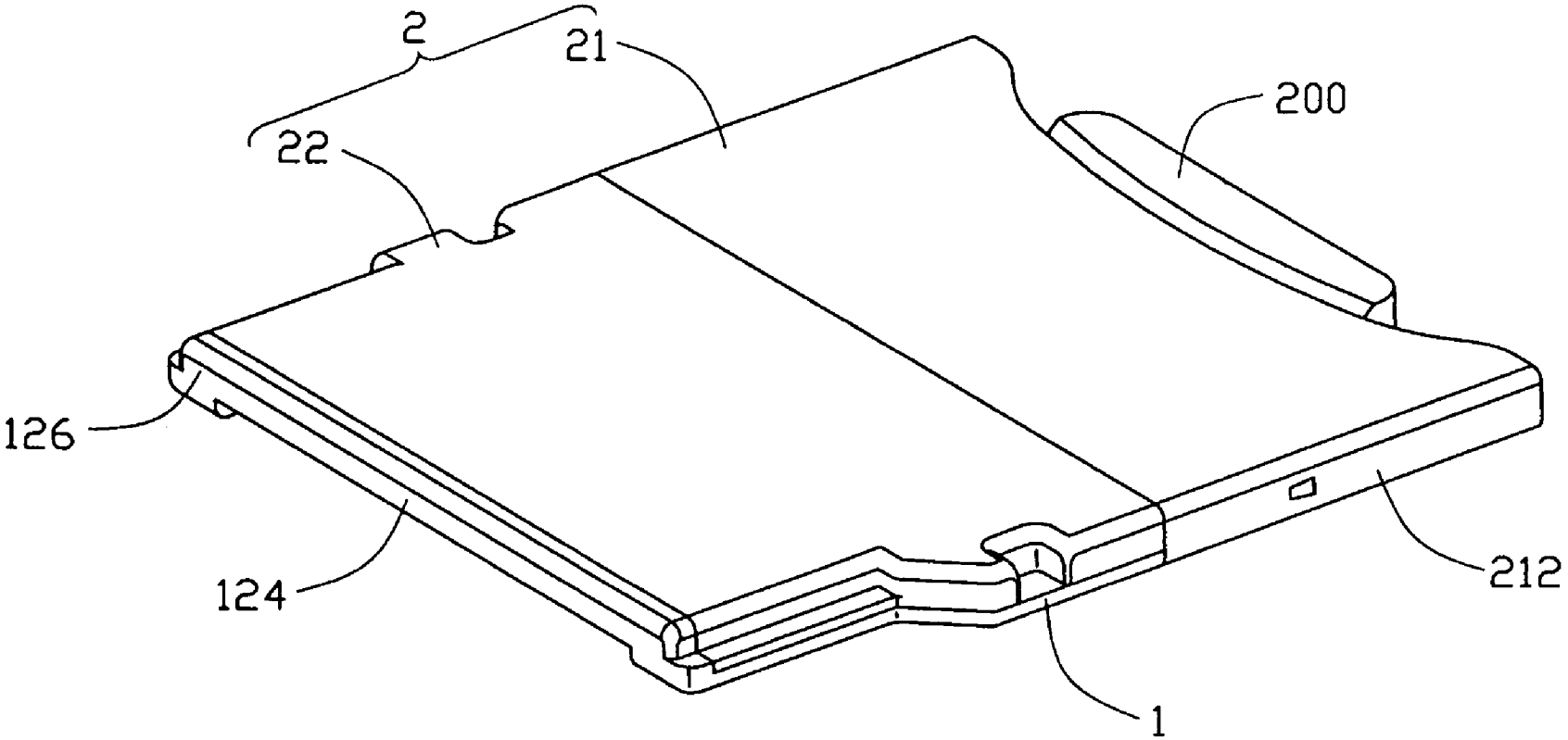
FIG. 1 is a perspective view of a memory card adapter with a mini memory card therein according to a first embodiment of the present invention.

Reference will now be made to the drawing figures to describe the present invention in detail.

With reference to FIGS. 1-6, a memory card adapter 100 for a mini memory card 200 with respect to a first preferred embodiment of the present invention is shown. The memory card adapter 100 comprises an insulating lower cover 1 extending in a front-to-back direction, an upper cover 2 engaged with the insulating lower cover 1, a conductive terminals module 3 and a conductive member 4 mounted on a top face 120 of the insulating lower cover 1. The insulating lower cover 1 is made of a resin material and comprises a front portion 11 and a rear portion 12. The upper cover 2 comprises a metal cover 21 and a resin cover 22 engaged with the front portion 11 and the rear portion 12, respectively. A mini memory card receiving space 10 with a configuration substantially as the mini memory card 200 is provided between the front portion 111 and the metal cover 21. Another receiving room is defined between the rear portion 12 and the resin cover 22 for retaining the conductive terminals module 3 and the conductive member 4.

Now, detail description about all elements of the memory card adapter 100 will be made. To see FIGS. 5 and 6 and in conjunction with FIG. 3, the insulating lower cover 1 defines a mating end 13 with a mating opening 131, a pair of sidewalls 111 and bottom wall 112 to enclose the mini memory card receiving space 10. A pair of depressed engaged portions 114 is defined at a bottom face 110 of the pair of sidewalls 111. One of the sidewalls 111 provides a stop portion 113 protruded toward the mini memory card receiving space 10. The rear portion 12 is provided with a pair of rectangular protrusions 121 protruded upward from the top face 120 thereof and connecting with the sidewalls 111. A depressed portion 125 is defined at the bottom face 110 of insulating lower cover 1 and located at a free rear end 126. A plurality of through openings 123 in a line is defined at the depressed portion 125 area.

The conductive terminals module 3 comprises an elongated resin beam 31 and a plurality of conductive terminals 32 received in the resin beam 31. Each conductive terminal 32 has a contacting portion 321 and a tail portion 322 both extending outside the resin beam 31. In this preferred embodiment, the conductive terminals 32 are secured in the elongated beam 31 via an insert-molded process.

Figure 2:
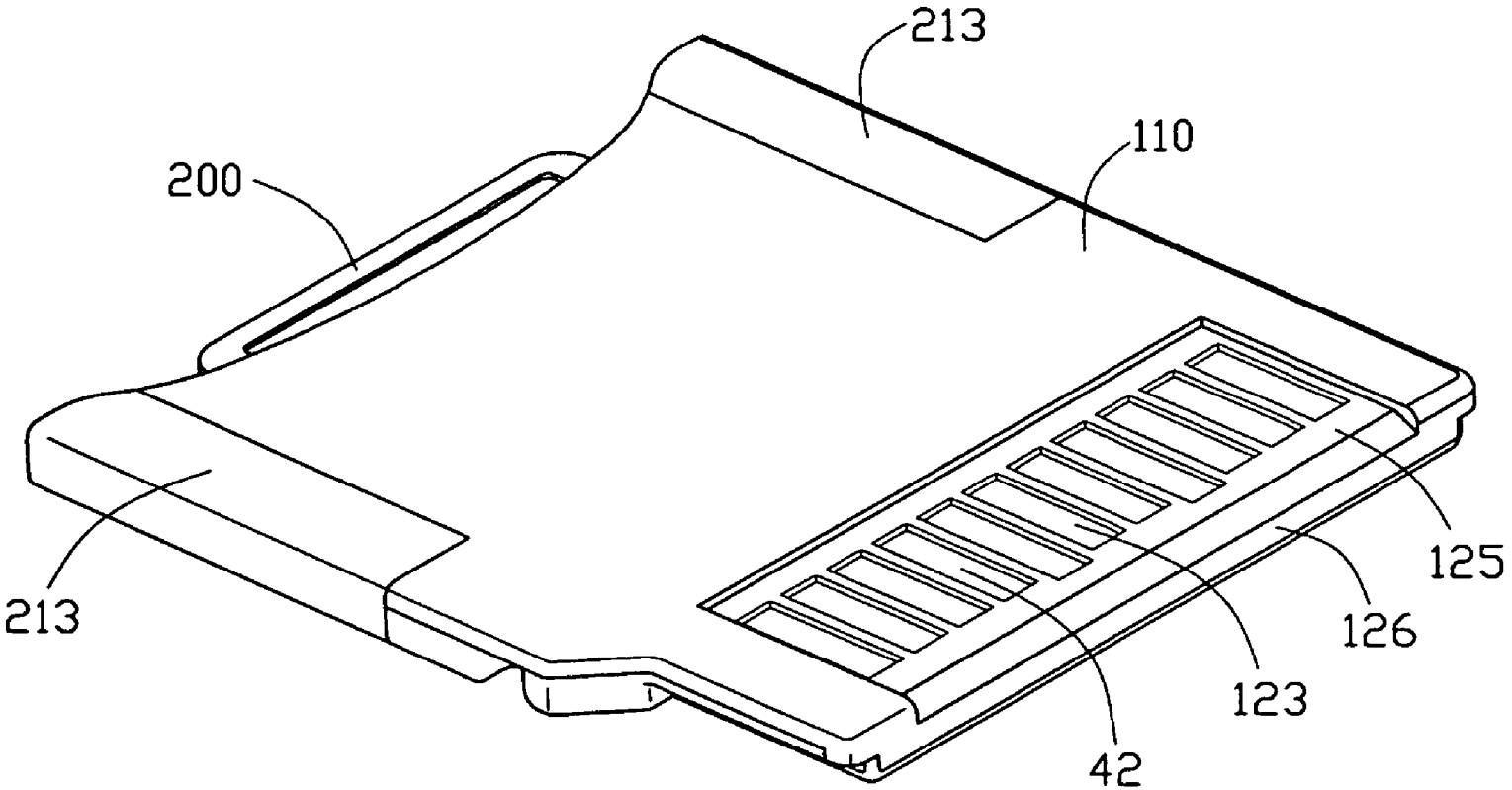
FIG. 2 is another perspective view of the memory card adapter shown in FIG. 1, while taken from another aspect.
Figure 3:
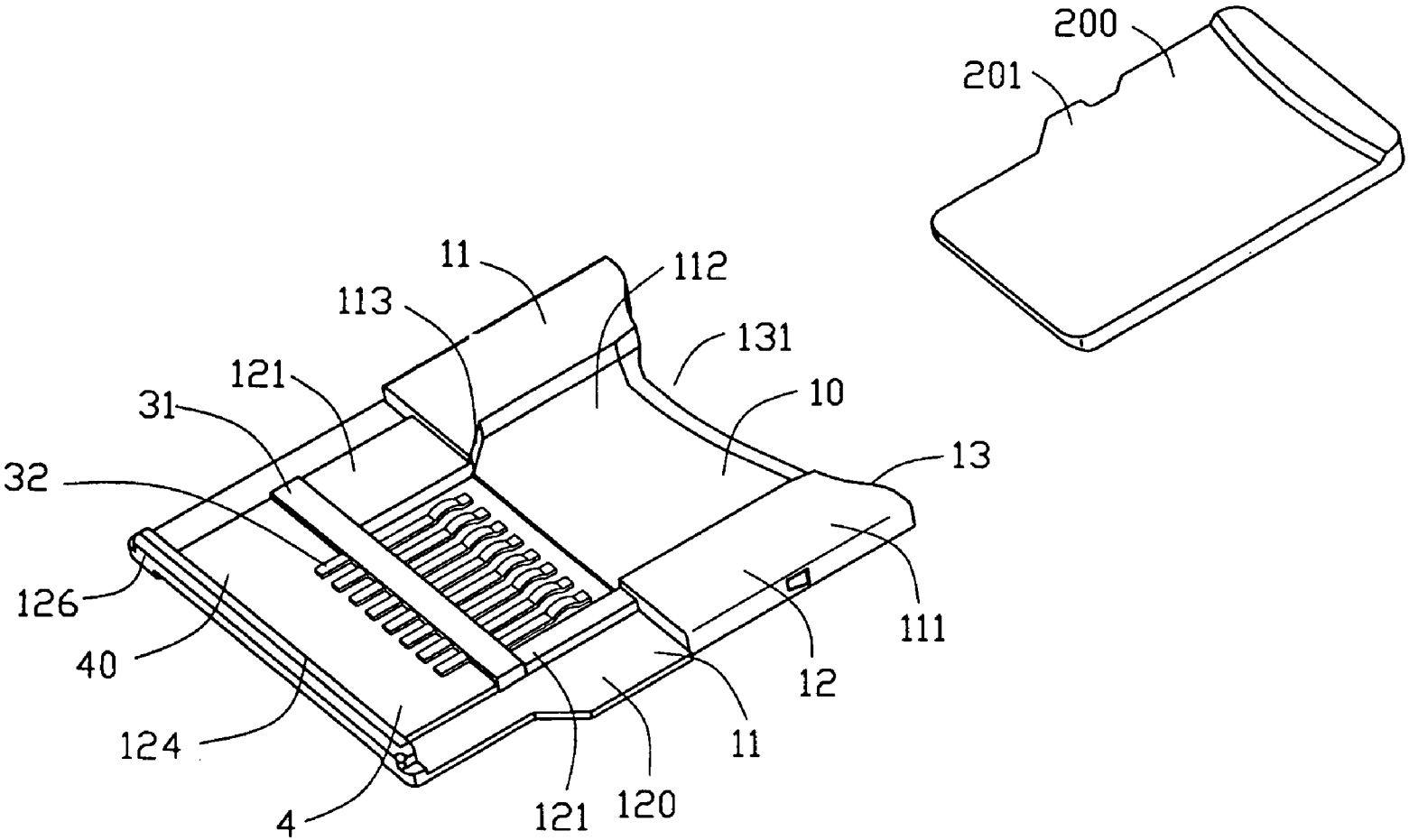
FIG. 3 is a perspective view of the memory card adapter shown in FIG. 1, showing the mini memory card detached from the memory card adapter and without an upper cover mounted thereon.

The conductive member 4 defines a plurality of conductive wires 41 on a top face 40 thereof and a plurality of conductive pads 42 on a bottom face thereof. The conductive member 4 is positioned upon the line of through openings 123, which leaves a receiving slot (not labeled) between the conductive member 4 and the pair of protrusions 121 in the front-to-back direction. The plurality of conductive pads 42 is aligned with the line of through openings 123, respectively, and exposed to outsides as shown in FIG. 2. The elongated resin beam 31 is positioned into the receiving slot defined between the conductive member 4 and the pair of protrusions 121 as clearly shown in FIGS. 3 and 4. The tail portions 322 are supported one the top face 40 of the conductive member 4 and electrically connecting with the conductive wires 42. The contacting portions 321 are supported on the top face 120 of the rear portion 12 and located between the pair of protrusions 121. Besides, the insulating lower cover 1 further defines a positioning beam 124 at the rear free end 126 thereof to secure the conductive member 4 in a proper position.

The resin cover 22 is configured as a mating end of a simulated mini SD card. The resin cover 22 defines a front engaged end 221, a rear engaged end 223, a top face 220 and a bottom face 222. The bottom face 222 is defined with a main depression 224 therein to accommodate the conductive member 4, the conductive module 3 and the pair of protrusions 121. In the main depression 224, a pair of secondary protrusions 226 is defined on an inner surface of the resin cover 22. The resin cover 22 engages with the rear portion 12 of the insulating lower cover 1 in a manner that the rear engaged end 223 abuts against a front face of the positioning beam 124, the front engaged end 221 abuts against a rear face the pair of sidewalls 111 and the pair of secondary protrusions 226 is aligned and engages with the pair of rectangular protrusions 121 of the insulating lower cover 1. In this embodiment, the resin cover 22 can be appropriately jointed with the insulating lower cover 1 by means of ultrasonic welding, thermal bonding, adhesive joining, or caulking.

In the present embodiment, the metal cover 21 defines a top wall 211 with an opening 214 formed at a front end 210 thereof, a pair of bottom walls 213 opposite to the top wall 211 and a pair of sidewalls 212 connecting with the top walls 211 and the bottom walls 213. The pair of bottom walls 213 extends from the pair of sidewalls 212 and toward each other. In assembly, the metal cover 21 is assembled to the insulating lower cover 1 in the front-to-back direction with the pair of sidewalls 212 engaged with the depressed engaged portions 114 of the insulating lower cover 1. A rear end 218 of the metal cover 21 confront to the front engaged end 221 of the resin cover 22 and an upper face of the top wall 211 is coplanar with the top face 220 of the resin cover 22. As a result, the upper cover 2 including the resin cover 22 and the metal cover 21 is consistent from front to rear.

Figure 4:
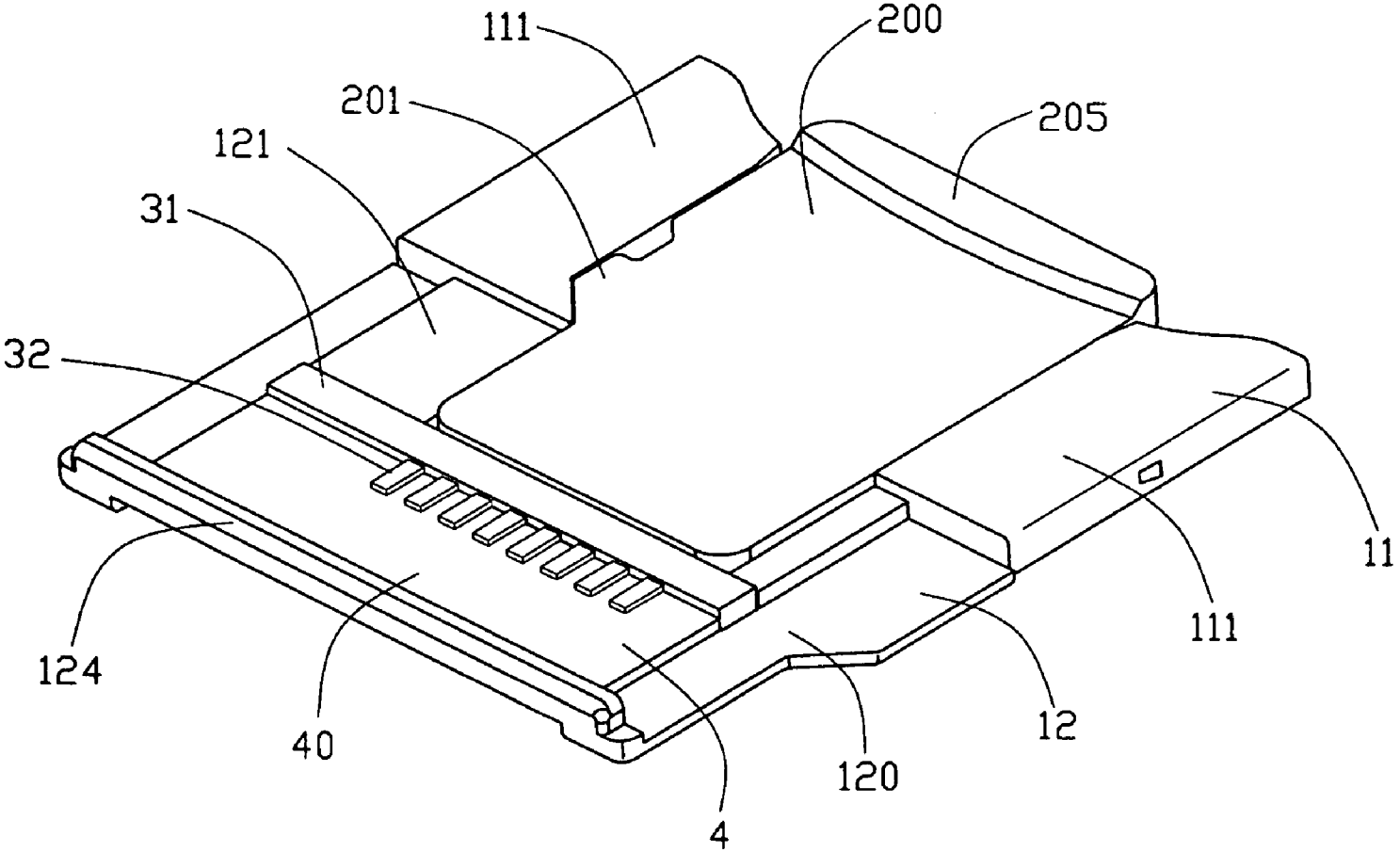
FIG. 4 is a perspective view of the memory card adapter shown in FIG. 1, showing the mini memory card inserted into the memory card adapter and without the upper cover mounted thereon.
Figure 5:
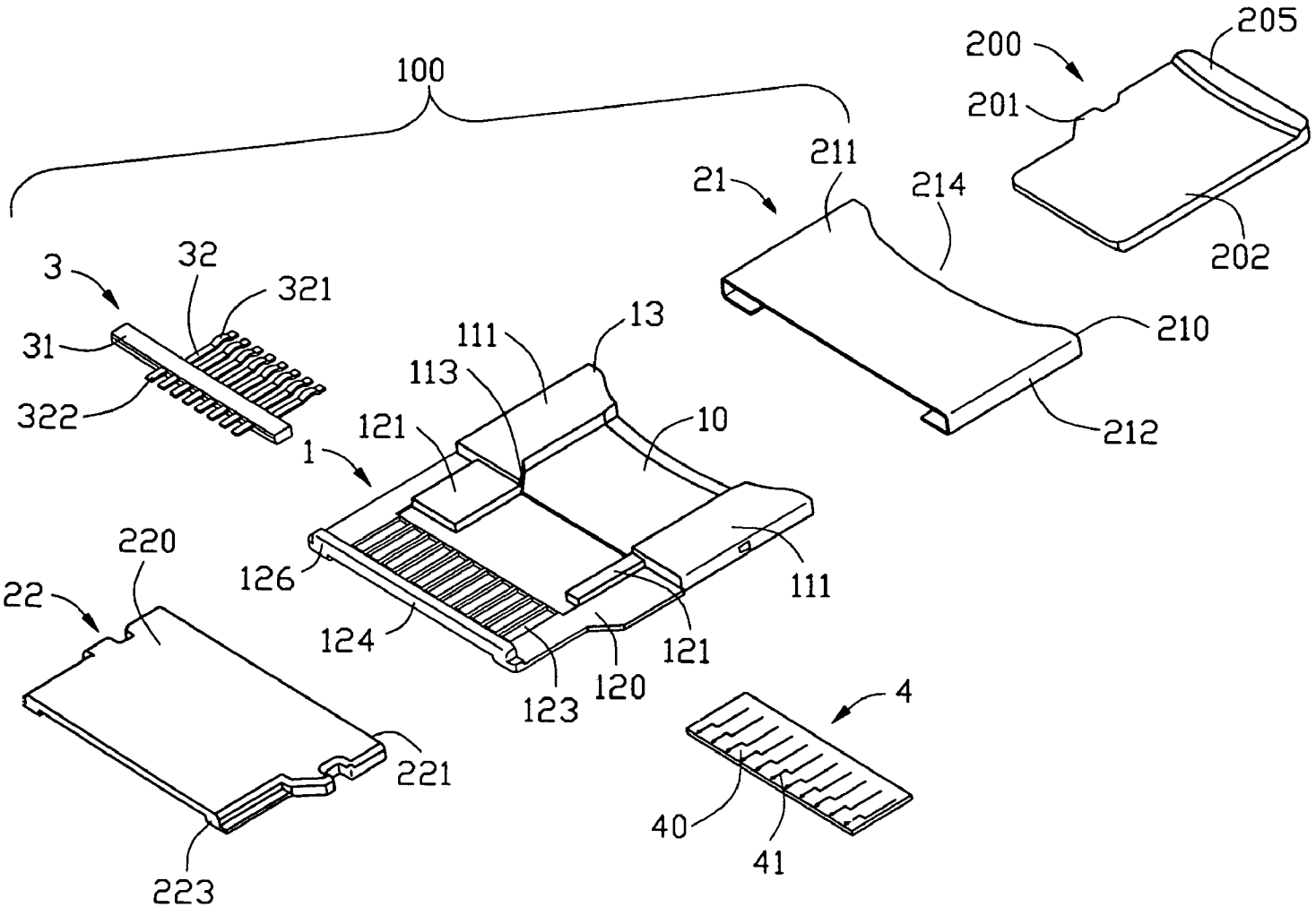
FIG. 5 is an exploded perspective view of the memory card adapter shown in FIG. 1.
Figure 6:
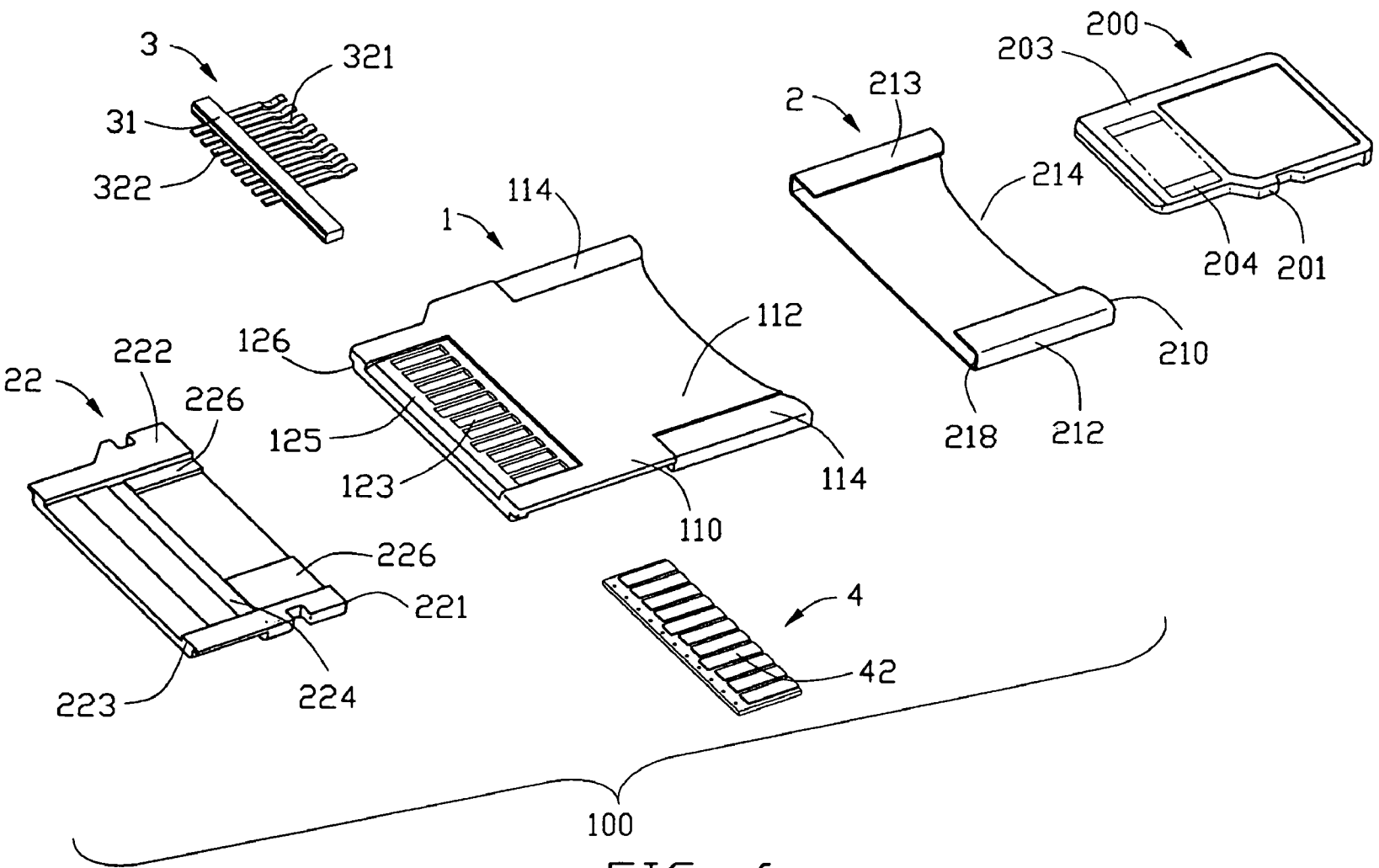
FIG. 6 is another exploded perspective view of the memory card shown in FIG. 2.

In use, the mini memory card 200 is inserted into the mini memory card receiving space 10 formed between the metal cover 21 and the insulating lower cover 21 through the mating opening 131. In this embodiment, the mating opening 131 specifically formed between the insulating lower cover 1 and the metal cover 21 at the mating end 13 thereof. The mini memory card 200, which is in a specification of micro SD card, includes a step portion 201 at a side thereof, a plurality of conductive pads 204 formed on a bottom face 203 at a rear end thereof and a projecting portion 205 projecting upwardly from a top face 202 thereof and located at a front end thereof. When the mini memory card 200 inserted into the mini memory card receiving space 10 at its proper position, the step portion 201 is obstructed against by the stop portion 113 of the insulating lower cover 1 and the projecting portion 205 may be obstructed against by the front end 210 of the metal cover 21 to prevent excessive insertion of the mini memory card 200, as shown in FIGS. 1 and 4. The conductive pads 204 of the mini memory card 200 electrically connect with the contacting portions 321 of the conductive terminals 32. As a result, the mini memory card 200 (micro SD card in this embodiment) is converted to a regular sized memory card (mini SD card in this embodiment). To read/write data on the mini memory card 200, a customer only need a memory card adapter, such as the memory card adapter 100 in the present embodiment, to accommodating the mini memory card 200 therein and electrically and mechanically connecting with an electronic device through a regular sized receiving slot, such as a mini SD card receiving slot. Thus, the mini memory card 200 can be used as a regular sized memory card.

Additional, as shown in FIG. 1, after the mini memory card 200 inserted into the memory card adapter 100, the projecting portion 205 of the mini memory card 200 is outside the memory card adapter 100 through the mating opening 131 and the opening 214 of the metal cover. With this arrangement, the mini memory card 200 can be drawn from the memory card adapter 100 conveniently.

Figure 7:
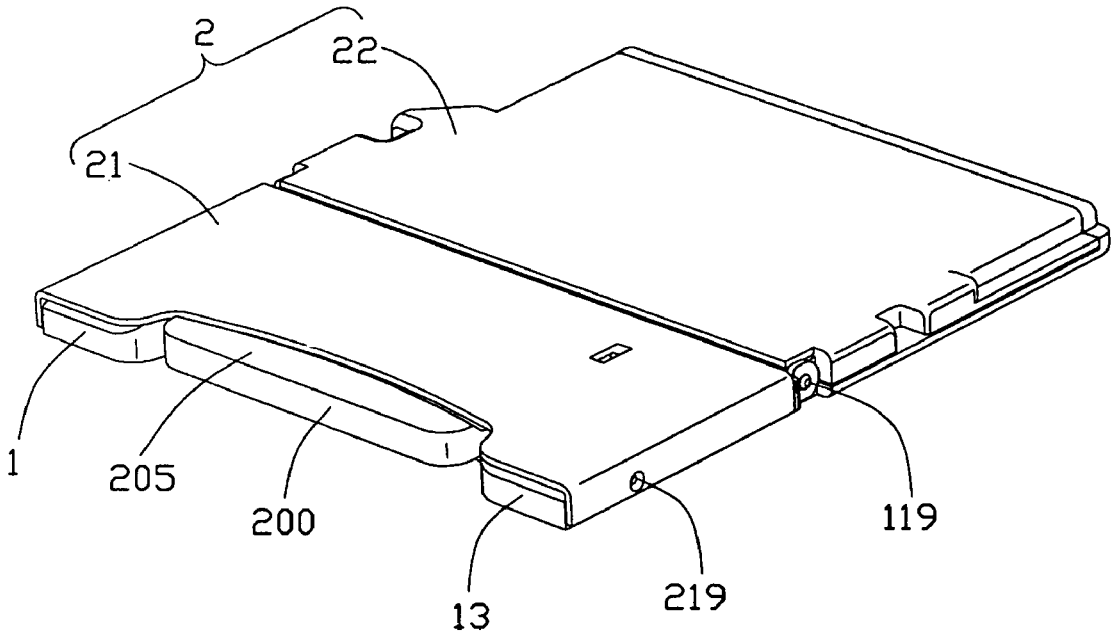
FIG. 7 is a perspective view of a memory card adapter with a mini memory card therein according to a second embodiment of the present invention.
Figure 8:
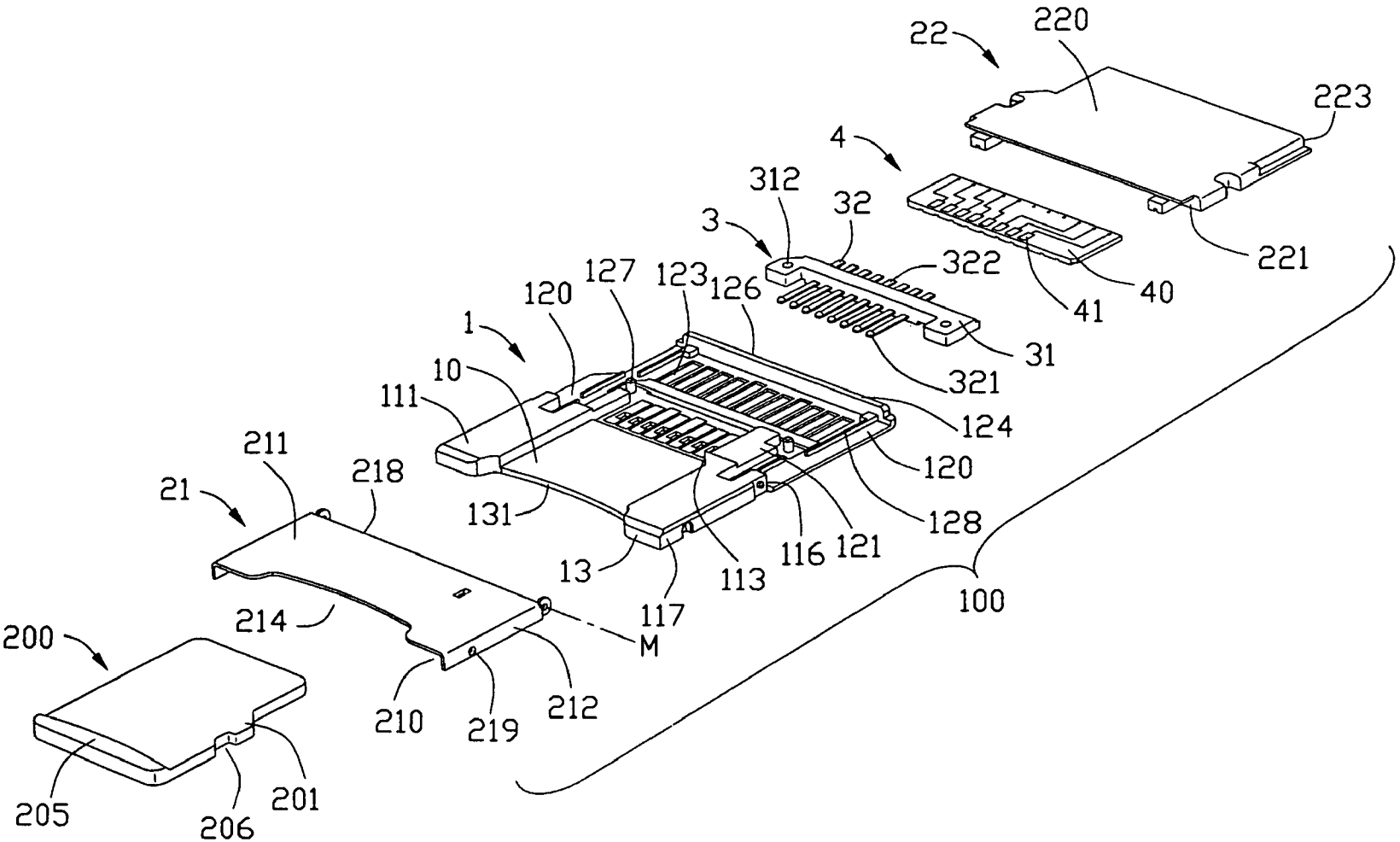
FIG. 8 is an exploded perspective view of the memory card adapter shown in FIG. 7.
Figure 9:
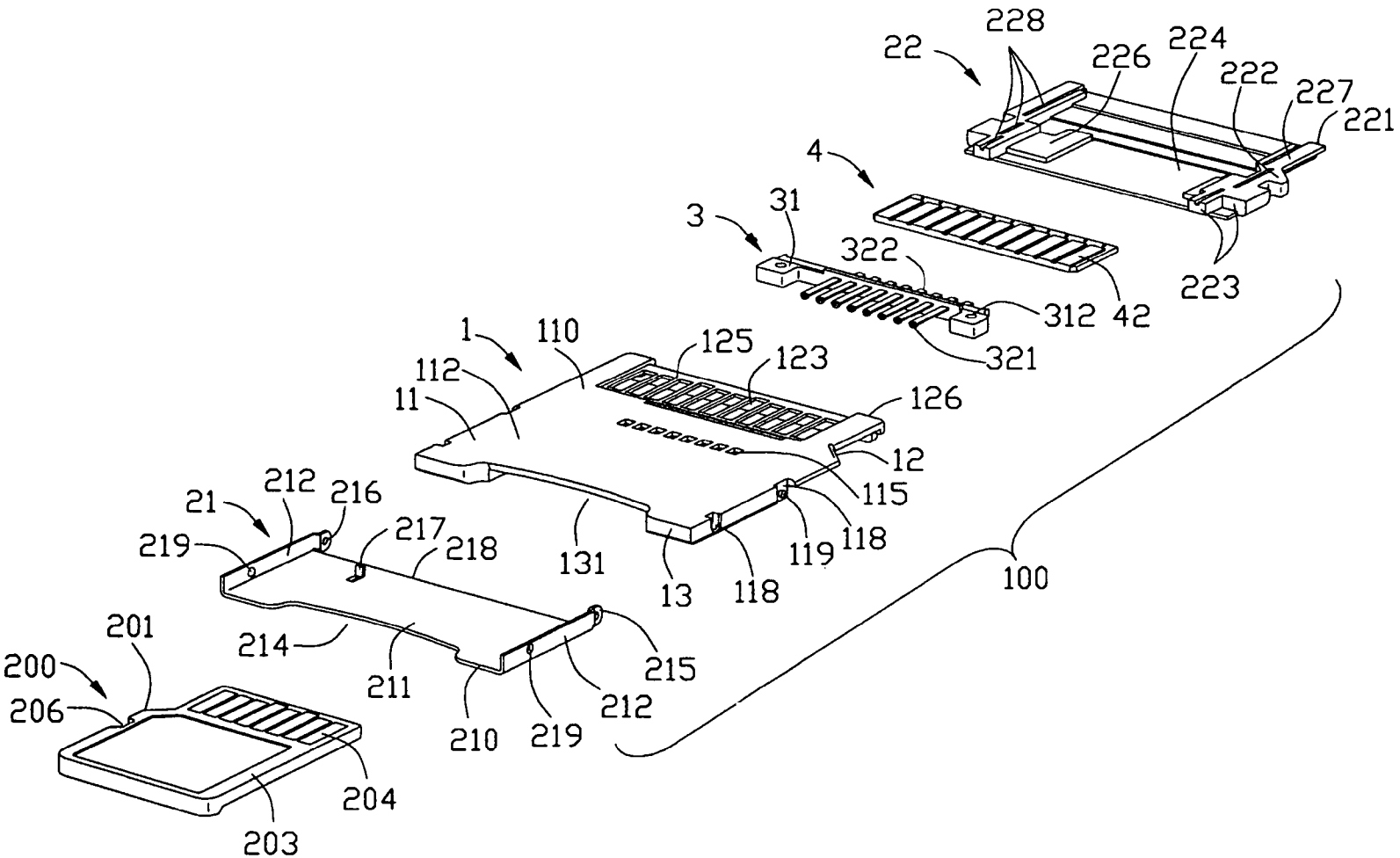
FIG. 9 is another exploded perspective view of the memory card adapter shown in FIG. 7, while taken from another aspect.

With reference to FIGS. 7-11, a memory card adapter with respect to a second preferred embodiment of the present invention is shown. To facilitate reading the description and viewing the drawing, same elements of the memory card adapter according to different embodiment of the invention are designated with same numerals. So the memory card adapter according to the second preferred embodiment of the present invention is also designated with the numeral 100, as shown in FIGS. 8 and 9. Most of the elements with respect to the present embodiment are similar to those in the first embodiment except the details described below. This memory card adapter 100 comprises an insulating lower cover 1 extending in a front-to-back direction, an upper cover 2 engaged with the insulating lower cover 1, a conductive terminals module 3 and a conductive member 4 mounted on a top face 120 of the insulating lower cover 1. The insulating lower cover 1 is made of a resin material and comprises a front portion 11 and a rear portion 12. The upper cover 2 comprises a metal shell 21 and a resin cover 22 engaged with the front portion 11 and the rear portion 12, respectively. A mini memory card receiving space 10 with a configuration substantially as the mini card 200 is provided between the front portion 11 and the metal cover 21. Another receiving room is defined between the rear portion 12 and the resin cover 22 for retaining the conductive terminals module 3 and the conductive member 4.

As shown in FIGS. 8 and 9, the insulating lower cover 1 defines a mating end 13 with a mating opening 131, a pair of sidewalls 111 and a bottom wall 112 to enclose the mini memory card receiving space 10. One of the sidewalls 111 provides a stop portion 113 protruded toward the mini memory card receiving space 10. The rear portion 12 is provided with a pair of rectangular protrusions 121 and elongated tabs 128 protruded upward from the top face 120 thereof, wherein the rectangular protrusions 121 connecting with the sidewalls 111. A depressed portion 125 is defined at the bottom face 110 of insulating lower cover 1 and located at a free rear end 126. A plurality of through openings 123 in a line is defined at the depressed portion 125 area. A line of slots 115 is defined through the bottom wall 112 in a position before the line of through openings 123. Between the line of slots 115 and the line of through openings 123, a pair of posts 127 extend from the bottom wall 112 upwardly. The sidewalls 111 have a thickness more than that of the rear portion 12 of the insulating lower cover 1, so that a step portion 116 is formed at a rear end of the sidewalls 111. On each outer side surface 117 of the sidewalls 111, two notches 118 are formed thereon. The two notches 118 both penetrate into the sidewalls 111 from the outer side surface 117, and one is located at position near the mating end 13, another is located at position near the step portion 116. A pair of pivot shafts 119 is provided in the notches 18 formed at the rear end of the sidewalls 111. Besides, the insulating lower cover 1 further defines a positioning beam 124 at the rear free end 126 thereof to secure the conductive member 4 in a proper position.

The conductive terminals module 3 with respect to the present embodiment is slightly different from the one in the first embodiment, which comprises an elongated resin beam 31 and a plurality of conductive terminals 32 received in the resin beam 31. The resin beam 31 is formed with a pair of through holes 312 at two ends thereof. The pair of through holes 312 engages with the pair of posts 127 of the insulating lower cover 1. Each conductive terminal 32 has a contacting portion 321 and a tail portion 322 both extending outside the resin beam 31. The contacting portions 321 are in a manner of tab and are aligned with the line of slots 115, respectively. In the present preferred embodiment, the conductive terminals 32 are secured in the elongated beam 31 via an insert-molded process, too.

The conductive member 4 and assembly of which with the insulating lower cover 1 of the present embodiment is same to that in the first embodiment of the invention, so the description thereon is omitted here. The elongated resin beam 31 of the conductive terminals module 3 is positioned into a receiving slot defined between the conductive member 4 and the pair of protrusions 121 same to what is described in the first embodiment. The pair of posts 127 mate with the pair of through holes 312 of the resin beam 31. The tail portions 322 are supported one the top face 40 of the conductive member 4 and electrically connecting with the conductive wires 42. The contacting portions 321 are supported on the top face 120 located between the pair of protrusions 121. In the present embodiment, the line of slots 115 defined in bottom wall 112 of the insulating lower cover 1 are aligned with the contacting portions 321 to provide allowance for downward movement of the contacting portions 321.

The resin cover 22 is configured as a mating end of a simulated mini SD card. The resin cover 22 defines a front engaged end 221, a rear engaged end 223, a top face 220 and a bottom face 222. The bottom face 222 is defined with a main depression 224 therein and leaves a pair of sidewalls 227 located at two side of the main depression 224. The main depression 224 is to accommodate the conductive member 4, the conductive module 3 and the pair of protrusions 121. In the main depression 224, a pair of secondary protrusions 226 is defined on an inner surface of the resin cover 22. The sidewalls are defined with a plurality of notches 228 to mate with the elongated tabs 128 of the insulating lower cover 1. The resin cover 22 firmly engages with the rear portion 12 of the insulating lower cover 1 in a manner that the notches 228 mate with the elongated tabs 128 of the insulating lower cover 1, the rear engaged end 223 abuts against a front face of the positioning beam 124, the front engaged end 221 abuts against the step portion 116 of the insulating lower cover 1, and the pair of secondary protrusions 226 is aligned and engages with the pair of rectangular protrusions 121 of the insulating lower cover 1. In the present embodiment, the resin cover 22 is appropriately jointed with the insulating lower cover 1 by means of a mechanical engagement as mentioned above.

Figure 10:
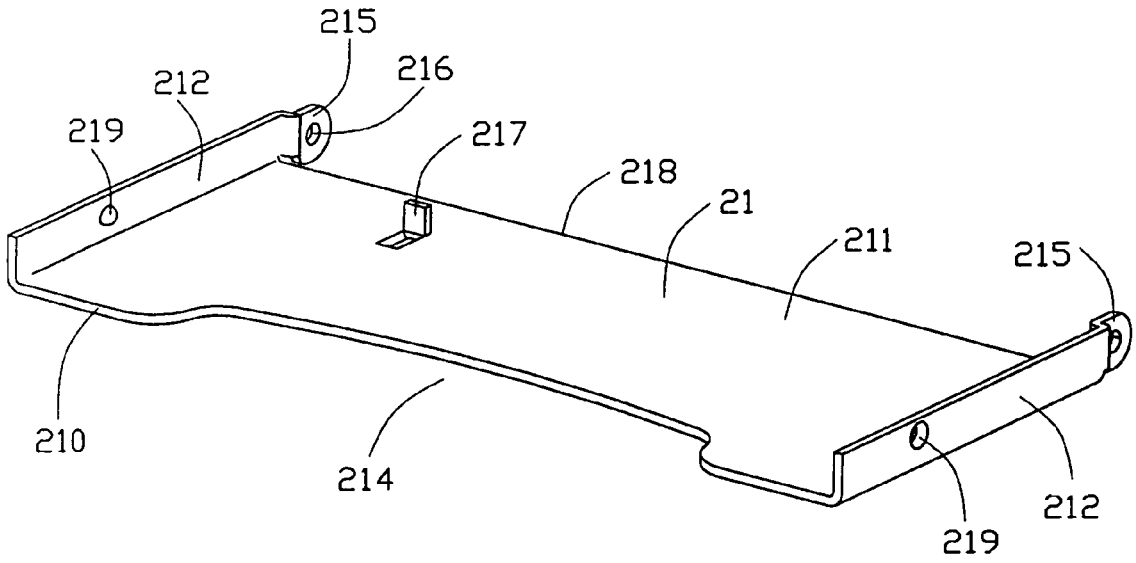
FIG. 10 is an enlarged perspective view of an upper cover of the memory card adapter shown in FIG. 9.

The metal cover 21 in the second embodiment is different from the one in the first embodiment. Specifically, the metal cover 21 in the present embodiment defines a top wall 211 with an opening 214 formed at a front end 210 thereof and a pair of sidewalls 212 connecting with the top walls 211, as shown in FIG. 10 and in conjunction with FIGS. 8 and 9. A pair of tabs 215 extends from a rear end 218 of the sidewalls 212 inwardly and rearwardly. The pair of tabs 215 each is formed with a through hole 216 therein. The pair of through holes 216 defines a pivot axis M. The sidewalls 212 each is provided with a retaining portion, such as a dimple 219, protruded inwardly near the mating end 210 thereof. The top wall 211 is provided with a locking portion 217 protruded inwardly. In assembly, the pair of tabs 215 is received in the notches 118 near the rear portion 12 of the insulating lower cover and the through holes 216 of the tabs 215 mate with the pivot shafts 119 in the corresponding notches 118. Thus, the metal cover 21 is pivotally assembled to the insulating lower cover 1. But, there is no engagement between the metal cover 21 and the resin cover 22 in the present embodiment.

In use, the mini memory card 200 is inserted into the mini memory card receiving space 10 formed between the metal cover 21 and the insulating lower cover 21 through the mating opening 131, in a mating direction. The mini memory card 200, which is in a standard specification of micro SD card same to what is described in the first embodiment above. A notch portion at a lengthwise side thereof is designated with numeral 206. When there is a need to accommodate the mini memory card 200 in the card adapter 100, the metal cover 21 first pivoted around the pivot shafts 119 to an opening position where the metal cover 21 is inclined with respect to the insulating lower cover to allow the mini memory card 200 inserted into the mini memory card receiving space 10. The stop portion 113 of the sidewall 111 of the insulating lower cover 1 obstructs against the step portion 201 of the mini memory card 200 to prevent excessive insertion of the mini memory card 200. The conductive pads 204 of the mini memory card 200 electrically connect with the contacting portions 321 of the conductive terminals 32. At last, the metal cover 21 is pivoted to a closed position where the locking portion 217 latches with the notch portion 216 of the mini memory card 200 to lock the mini memory card 200 in its proper position and the dimples 219 engages with the notches 118 near the mating end 131 to secure the metal cover 21 in its closed position. Furthermore, at the closed position, an upper face of the top wall 211 of the metal cover 21 is coplanar with the top face 220 of the resin cover 22. As a result, the upper cover 2 including the resin cover 22 and the metal cover 21 is substantially consistent from front to rear. As a result, the mini memory card 200 (micro SD card in this embodiment) is converted to a regular sized memory card (mini SD card in this embodiment). To read/write data on the mini memory card 200, a customer only need a memory card adapter, such as the memory card adapter 100 in the present embodiment, to accommodating the mini memory card 200 therein and electrically and mechanically connecting with an electronic device through a regular sized receiving slot, such as a mini SD card receiving slot. Thus, the mini memory card 200 can be used as a regular sized memory card.

Additional, as shown in FIG. 7, after the mini memory card 200 inserted into the memory card adapter 100, the projecting portion 205 of the mini memory card 200 is outside the memory card adapter 100 through the mating opening 131 and the opening 214 of the metal cover. To draw the mini memory card 200 from the memory card adapter 100, the metal cover and the mini memory card first move upwardly slightly to disengage the dimples 219 from the notches 118; and then the metal cover 21 is pivoted from the closed position to the opening position to leave the mini memory card 200 being capable of being drawn out. The mini memory card 200 is drawn from the memory card adapter 100 conveniently via drawing the projecting portion 205. Besides, in the present embodiment, the pivot axis is perpendicular to the mating direction of the mini memory card 200.

Figure 11:
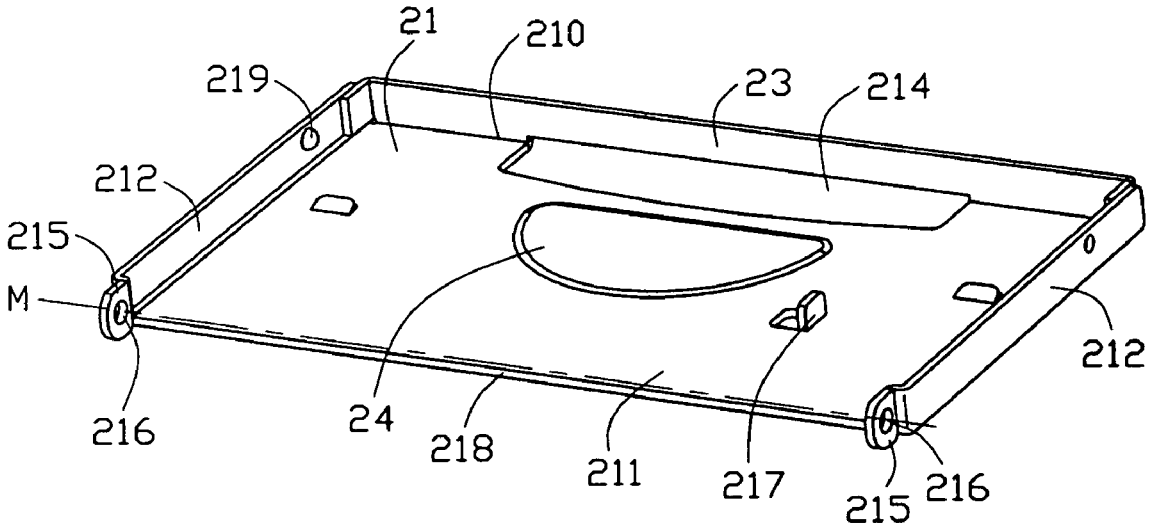
FIG. 11 is an enlarged perspective view of an upper cover of a memory card adapter according to a third embodiment of the present invention.
Figure 12:
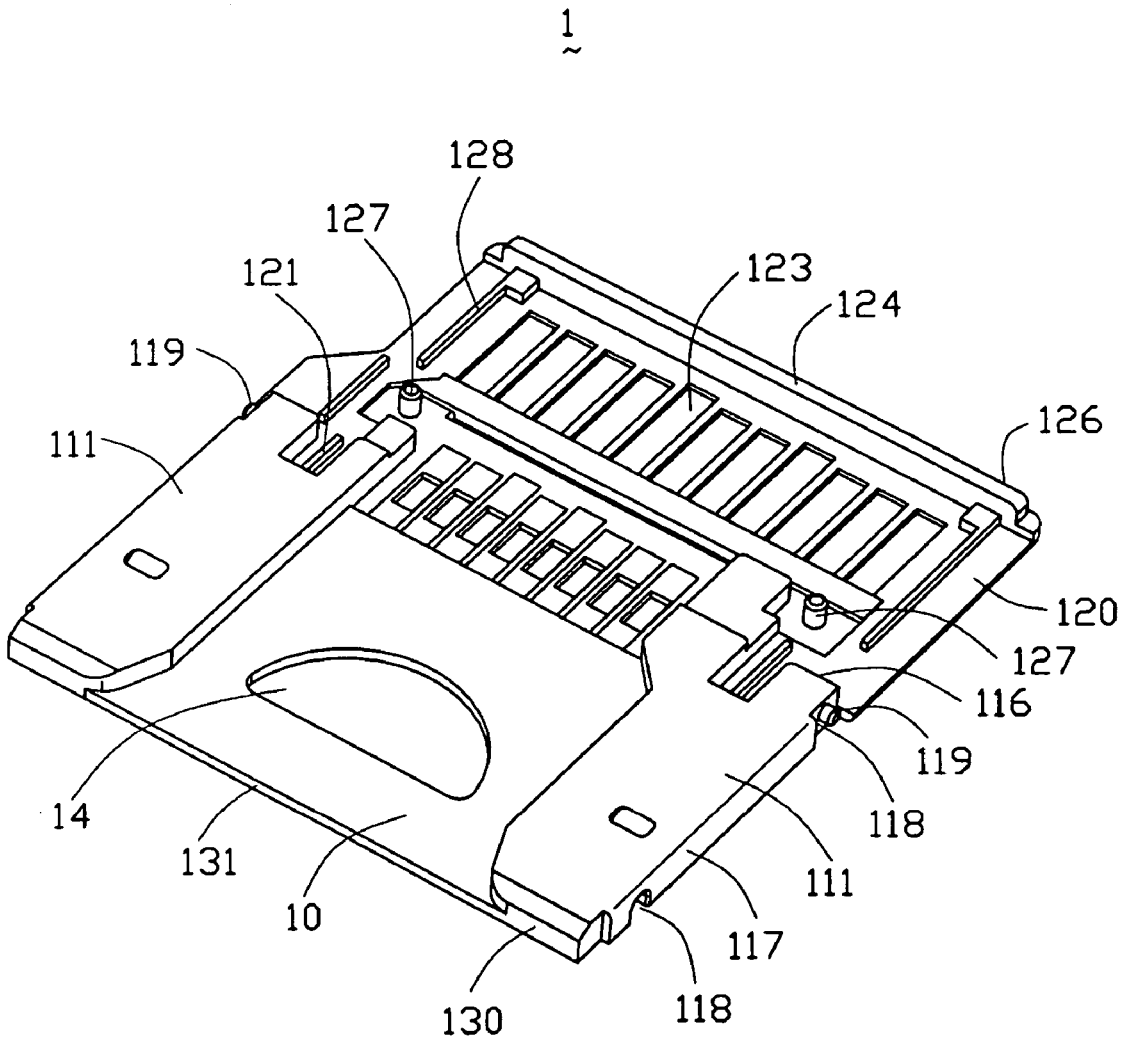
FIG. 12 is enlarged perspective view of an insulating lower cover which is to be assembled with the upper cover shown in FIG. 11.

With reference to FIGS. 11-12, a metal cover and an insulating lower cover with respect to a third preferred embodiment of the present invention is shown. To facilitate reading the description and viewing the drawing, same elements according to different embodiment of the invention are designated with same numerals. The third embodiment is substantially similar to the second embodiment. The conductive member 4, the conductive terminals module 3 and the mini memory card 200 in this two embodiment are in same arrangement. The insulating lower cover 1 and the metal cover 211 in this two embodiment are very similar to each other, except the details described below. The metal cover 21 according to the third embodiment further comprises a front wall 23 perpendicular to and connecting with the top wall 211 and the pair of sidewalls 212. The top wall 211 is formed with an opening 214 at the front end 210 thereof and a protrusion 24 protruded inwardly. The bottom wall 112 of the insulating lower cover 1 is provided with an operation opening 14 in communication with the mini memory card receiving space 10. In the case of the mini memory card 200 is accommodated in the memory card adapter 100, the front wall 23 encloses the mini memory card receiving space 10 and the protrusion 24 abuts against an top face of the mini memory card 200 to reduce a potential risk of unacceptable drawing out of the mini memory card 200. The projecting portion 205 of the mini memory card 200 is outside the memory card adapter 100 through the opening 214 of the metal cover 21.

In the case of ejecting the mini memory card 200 from the memory card adapter 100 with respect to the third embodiment, the min memory card 200 and the metal cover 21 is pushed upwardly by, for example, the user's fingerer inserted into the mini memory card receiving space 10 through the operation opening 14. Thereby the engagements of the dimples 219 with the notches 118 are released and the metal cover 21 is pivoted from its closed position toward its opening position. When the metal cover 21 at its opening position, the mini memory card 200 can be drawn out from the memory card adapter 100 conveniently. In this present embodiment, the pivot axis M is perpendicular to the mating direction of the mini memory card 200, too.

Figure 13:
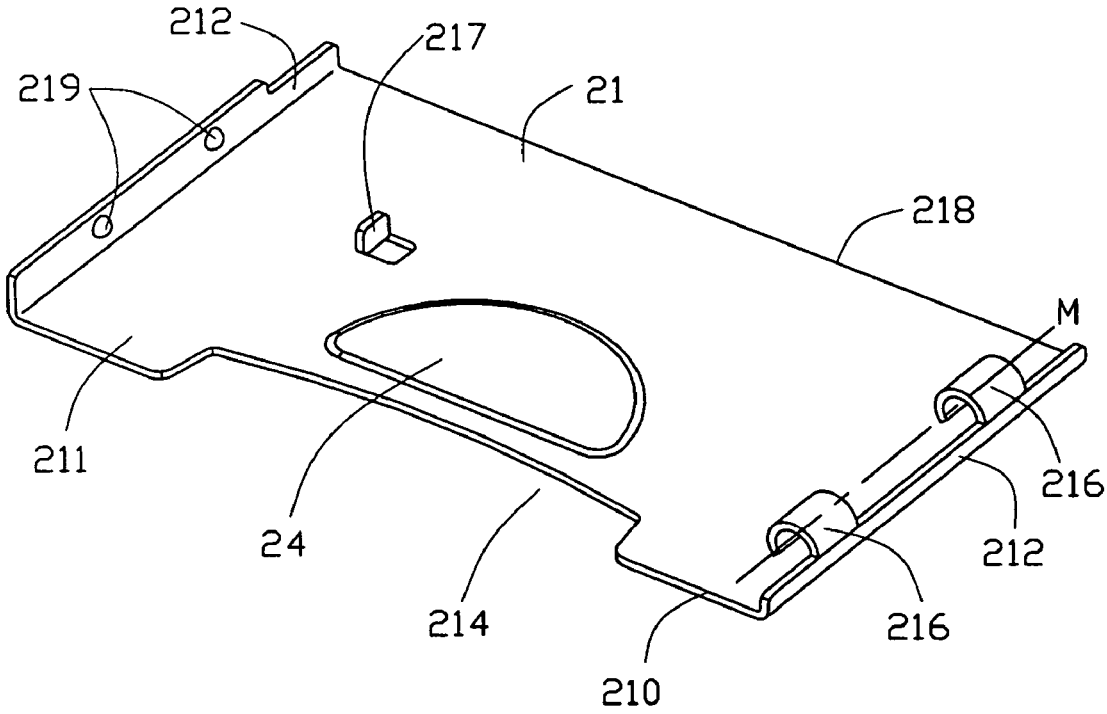
FIG. 13 is an enlarged perspective view of an upper cover of a memory card adapter according to a fourth embodiment of the present invention.
Figure 14:
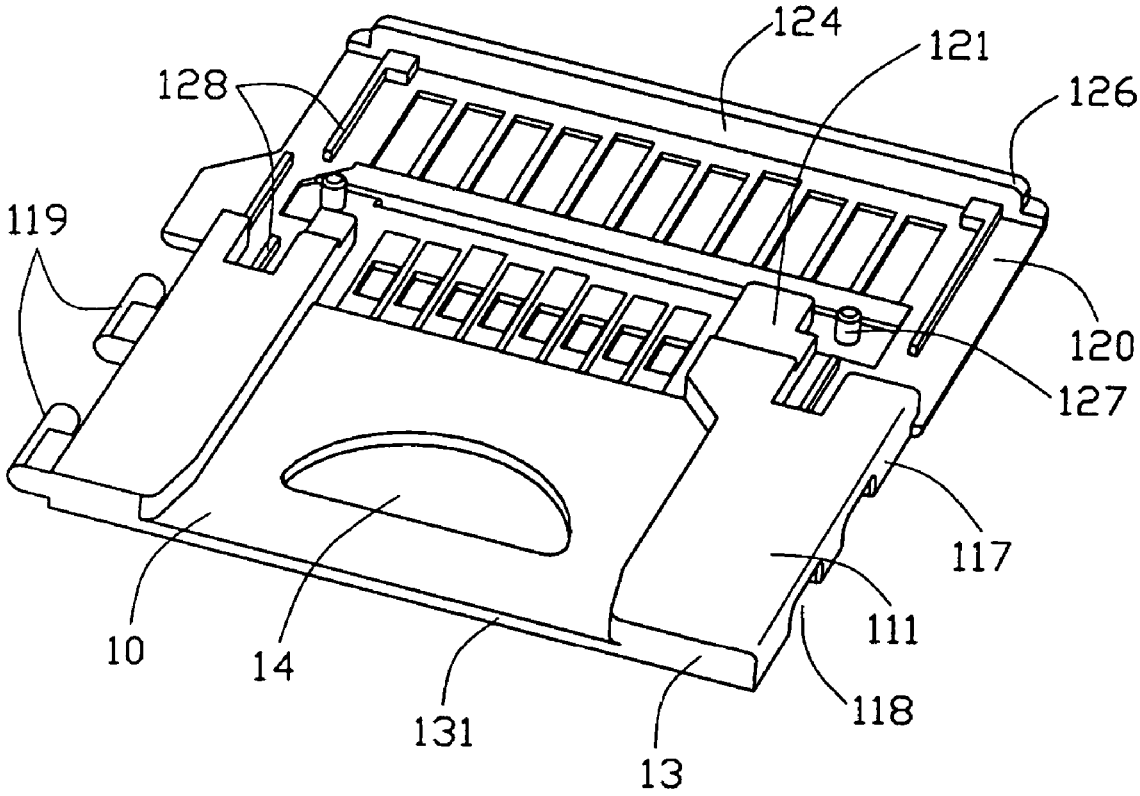
FIG. 14 is an enlarged perspective view of an insulating lower cover which is to be assembled with the upper cover shown in FIG. 13.

With reference to FIGS. 13 and 14, a metal cover and an insulating lower cover with respect to a fourth preferred embodiment of the present invention is shown. The fourth embodiment is substantially similar to the second embodiment except the different pivot manner thereof. In the fourth embodiment, a pivot axis M defined by the metal cover 21 is parallel to the mating direction of the mini memory card 200. The metal cover 21 according to the fourth embodiment is provides with a pair of pivotal engagement portion 216 at a sidewall 212 and a pair of dimples 219 at another sidewall 212 opposite to the pivotal engagement portion 216. The insulating lower cover 1 is provided with a pair of pivot shaft 119 at an outer side surface 117 of a sidewall 111 and two notches 118 at an outer side surface 117 of another sidewall 111. The metal cover 21 is pivotally assembled to the insulating lower cover 1 via the pivotal engagement portion 216 pivotal around the pivot shaft 119. In the case of the metal cover 21 is at its closed position, the dimples 219 of the metal cover engage with the notches 118 of the insulating lower cover 1. In addition, the top wall 211 of metal cover 21 further forms with a protrusion 24 protruded inwardly and the bottom wall 112 of the insulating lower cover 1 is provided with an operation opening 14 in communication with the mini memory card receiving space 101, same to the according elements in the third embodiment. So detailed description referring to the protrusion 24 and the operation opening 14 is omitted here. In use, the way to operation the mini memory card 200 and the metal cover 21 is same to what are disclosed in the third embodiment above, so detail description on how to use the memory card adapter in the fourth embodiment is omitted here, too.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A memory card adapter for receiving a mini memory card, comprising:

an upper cover;

an insulating lower cover defining a mating end with a mating opening, the insulating lower cover engaged with the upper cover with a mini memory card receiving space formed therebetween, the mini memory card being inserted into the mini memory card receiving space through the mating opening in a mating direction, the insulating lower cover being provided with at least one opening at another end thereof;

a conductive member mounted on the insulating lower cover, the conductive member comprising a plurality of conductive pads and conductive wires disposed thereon, the conductive pads being aligned with the opening of the insulating lower cover and exposed outside; and a conductive terminals module comprising a plurality of conductive terminals and a resin beam engaged with the insulating lower cover, each conductive terminals comprising a contacting portion electrically connecting with the mini memory card and a tail portion electrically connecting with the conductive wires.

2. The memory card adapter as claimed in claim 1, wherein the memory card adapter is configured to a mini SD memory card and the memory card is a micro SD card.

3. The memory card adapter as claimed in claim 1, wherein the resin beam is insert-molded over the conductive terminal.

4. The memory card adapter as claimed in claim 1, wherein the resin beam comprises a pair of retaining holes, and wherein the insulating lower cover comprises a pair of posts engaged with the pair of retaining holes.

5. The memory card adapter as claimed in claim 1, wherein the upper cover comprises a resin cover and a metal cover, the mini memory card receiving space being formed between the metal cover and the insulating lower cover.

6. The memory card adapter as claimed in claim 5, wherein the metal cover is pivotally assembled on the insulating lower cover.

7. The memory card adapter as claimed in claim 6, wherein a pivot axis of the metal cover is perpendicular to the mating direction.

8. The memory card adapter as claimed in claim 6, wherein a pivot axis of the metal cover is parallel to the mating direction.

9. The memory card adapter as claimed in claim 6, wherein the metal cover defining a top wall with an opening defined therein and a front wall perpendicular to and connecting with the top wall.

10. The memory card adapter as claimed in claim 6, wherein the metal cover is provided with a retaining portion engaging with the insulating lower cover to retain the metal cover in a closed position where the mini card secured in the mini memory card receiving space.

11. A memory card adapter for receiving a mini memory card, comprising:

an upper cover comprising a resin cover and a metal cover without engagement with the resin cover;

an insulating lower cover defining a mating end with a mating opening, the lower insulating cover engaged with the resin cover and the metal cover with a receiving room and a mini memory card receiving space formed therebetween, respectively, the mini memory card being inserted into the mini memory card receiving space through the mating opening in a mating direction, the insulating lower cover being provided with at least one opening at another end thereof;

a conductive member retained in the receiving room, the conductive member comprising a plurality of conductive pads and conductive wires disposed thereon, the conductive pads being aligned with the opening of the lower cover and exposed outside; and a plurality of conductive terminals secured on the lower cover, each conductive terminals comprising a contacting portion electrically connecting with the mini memory cad and a tail portion electrically connecting with the conductive wires.

12. The memory card adapter as claimed in claim 11, wherein the metal cover is pivotally assembled on the insulating lower cover.

13. The memory card adapter as claimed in claim 12, wherein a pivot axis of the metal cover is perpendicular to the mating direction.

14. The memory card adapter as claimed in claim 12, wherein a pivot axis of the metal cover is parallel to the mating direction.

15. The memory card adapter as claimed in claim 12, wherein the metal cover defines a top wall with a locking portion protruding into the mini memory card receiving space to lock with a corresponding notch defined in the mini memory card.

16. The memory card adapter as claimed in claim 11, further comprising a resin beam engaged with the insulating lower cover, the resin beam retaining the conductive terminals therein with the contacting portions and the tail portions extending beyond therefrom.

17. The memory card adapter as claimed in claim 16, wherein the resin beam is insert-molded over the conductive terminals.

* * * * *